United States Patent [19]

Knowles

[11] Patent Number: 4,501,102

[45] Date of Patent: Feb. 26, 1985

[54] COMPOSITE WOOD BEAM AND METHOD OF MAKING SAME

[76] Inventor: James Knowles, 1275 Club Dr., Bloomfield Hills, Mich. 48013

[21] Appl. No.: 356,997

[22] Filed: Mar. 11, 1982

Related U.S. Application Data

[63] Continuation of Ser. No. 113,370, Jan. 18, 1980, abandoned.

[51] Int. Cl.[3] ..... E04C 3/292; E04C 3/02

[52] U.S. Cl. ..... 52/690; 29/155 R; 52/693; 52/730

[58] Field of Search ..... 52/690, 691, 692, 694, 52/334, 639, 642, 730, 693; 403/283, 293, 292, 388, 389; 29/155 R

[56] References Cited

U.S. PATENT DOCUMENTS

| | | | |
|---|---|---|---|
| 1,417,657 | 5/1922 | Belcher | 52/694 |
| 3,177,619 | 4/1965 | Benjamin | 52/334 |
| 3,748,809 | 7/1973 | Jackson | 52/693 X |
| 4,078,352 | 3/1978 | Knowles | 52/696 X |
| 4,207,719 | 6/1980 | Knowles | 52/98 X |

FOREIGN PATENT DOCUMENTS

| | | | |
|---|---|---|---|
| 247162 | 10/1963 | Australia | 52/639 |
| 687082 | 5/1964 | Canada | 52/693 |
| 77435 | 7/1919 | Fed. Rep. of Germany | 52/642 |
| 2242329 | 3/1974 | Fed. Rep. of Germany | 52/690 |
| 667419 | 6/1929 | France | 52/334 |
| 81269 | 5/1919 | Switzerland | 52/730 |
| 222498 | 10/1942 | Switzerland | 52/334 |
| 1232592 | 5/1972 | United Kingdom | 52/690 |

*Primary Examiner*—Alfred C. Perham

*Attorney, Agent, or Firm*—Cullen, Sloman, Cantor, Grauer, Scott & Rutherford

[57] ABSTRACT

A joist-like wood beam formed of parallel, spaced apart, wood chords joined together by end and central elongated wood filler strips which fill the space between the chords at the opposite ends of and at the central portion of the chords. Sheet metal web units formed of angled struts are located between the central and end strips for spanning the space between and for interconnecting the chords between the strips. The chords and strips are joined together by staple-like mechanical fasteners embedded within the face of adjacent edge portions thereof. The fasteners are angled, relative to the chords, upwardly at an acute angle toward their nearest beam end so as to be placed in tension under beam loading thereby tightening the chords and strips together. Due to a tight, frictional, face-to-face engagement between the adjacent chord and filler strip surfaces, the filler strips and fasteners each absorb part of the shear forces resulting from normal beam loading and substantially increase the bending resistance of the beam.

8 Claims, 17 Drawing Figures

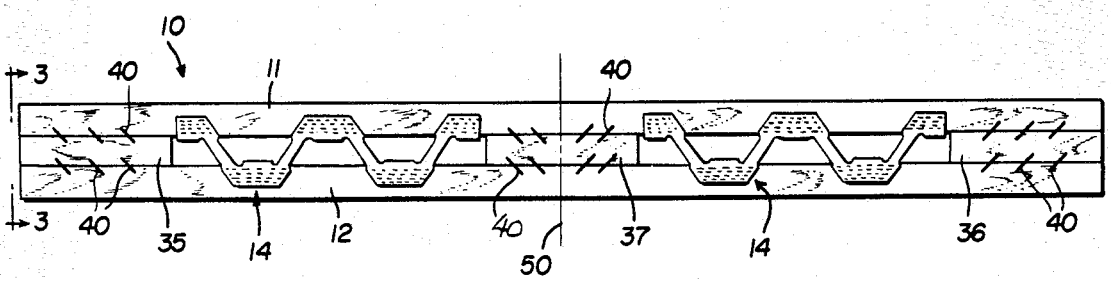
FIG. 1
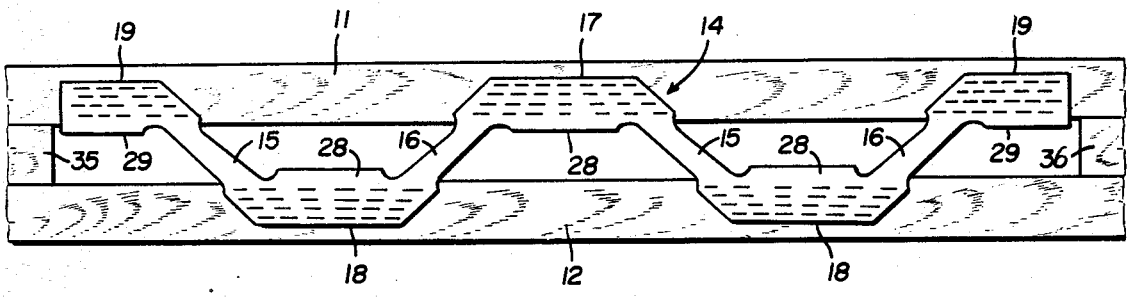
FIG. 2
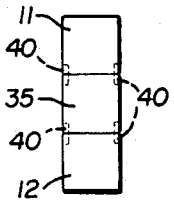
FIG. 3
FIG. 4
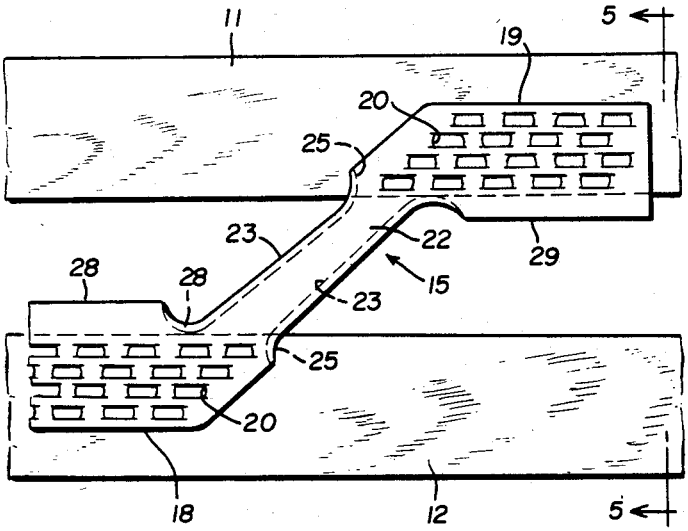
FIG. 5
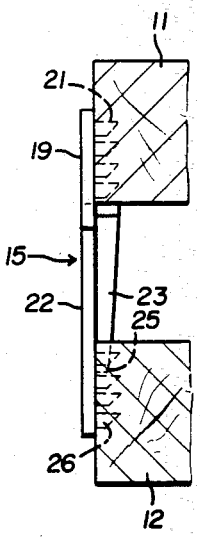

FIG. 7
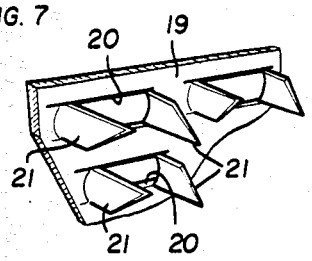
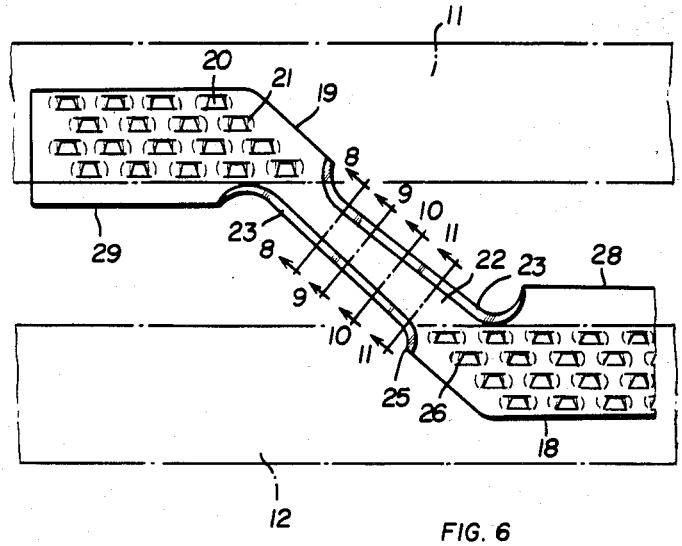
FIG. 6
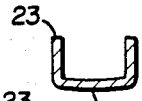
FIG. 8
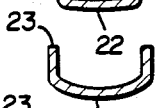
FIG. 9
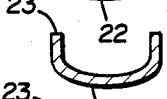
FIG. 10
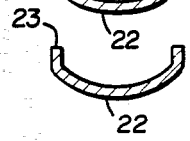
FIG. 11
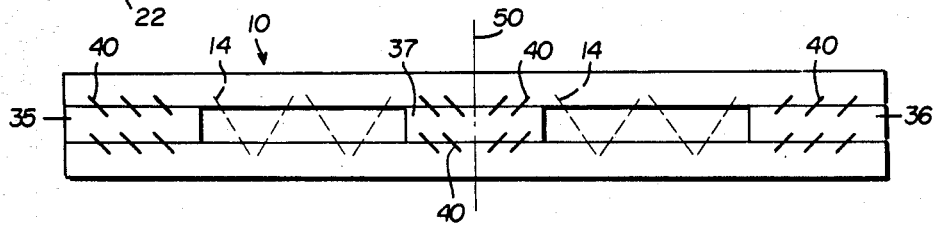
FIG. 12
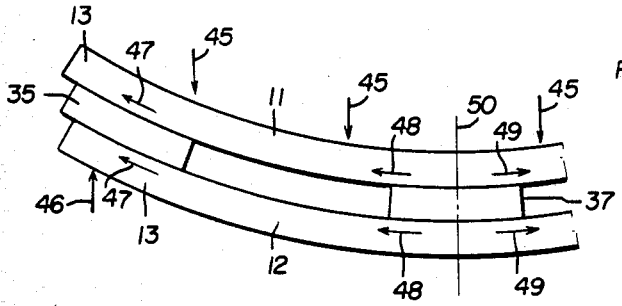
FIG. 13
FIG. 15
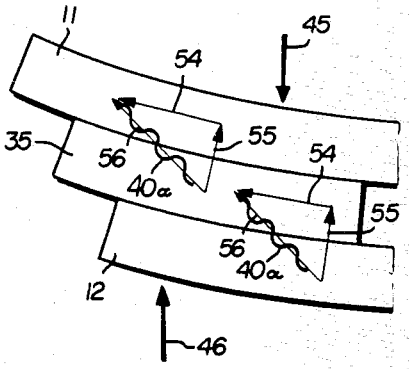
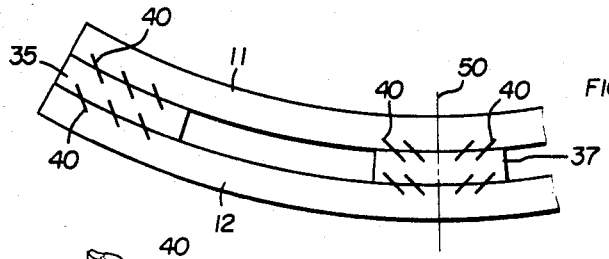
FIG. 14
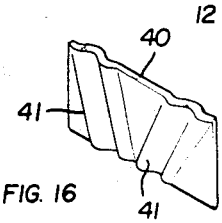
FIG. 16
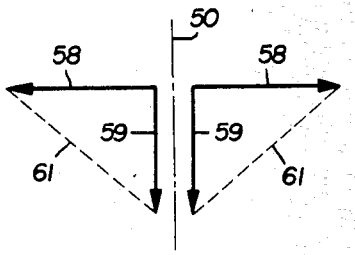
FIG. 17

COMPOSITE WOOD BEAM AND METHOD OF MAKING SAME

CROSS-REFERENCE TO RELATED APPLICATIONS

The present application, in part discloses and claims subject matter which is common to my earlier application Ser. No. 113,370, filed Jan. 18, 1980, now abandoned. Said earlier application, and this application, are also related to my application filed on Jan. 18, 1980, entitled "Metal Connector Struts for Truss-Like Beams", Ser. No. 113,171, now U.S. Pat. No. 4,308,703.

BACKGROUND OF INVENTION

The invention herein relates to truss-like fabricated joists or beams made of wood chords preferably interconnected by metal web units or struts. This type of beam is disclosed in my earlier U.S. patent application Ser. No. 893,317, filed Apr. 3, 1978, now U.S. Pat. No. 4,207,719 and identified as a "Composite Construction Beam".

In the construction of houses and other relatively small buildings, it is conventional to use solid wood beams for floor joists, ceiling supports, roof joists and the like. Generally such beams have nominal cross-sectional dimensions of 2×6, 4×8, 4×10, 4×12, etc. (inches). However, due to increased demand and decreasing availability of high grade lumber, the prices of lumber needed for making such beams have risen. Consequently, my earlier application Ser. No. 113,171, now U.S. Pat. No. 4,308,703, and the subject matter of this application are concerned with fabricated type beams which are made of more readily avilable, less expensive, smaller cross-section lumber, such as 2×4's, which lumber is interconnected with metal struts, and where the wooden members are interconnected by angled metal staples or fasteners.

The use of wood strips, interconnected by sheet metal web units or struts to fabricate trusses is known. Examples of such trusses are illustrated in the prior art U.S. patent to Sanford, No. 3,416,283, issued Dec. 17, 1968, and in my earlier U.S. Pat. No. 4,002,116, issued Jan. 11, 1979 and No. 4,078,352, issued Mar. 14, 1978. However, these prior trusses are, in general, more expensive and ordinarily must be designed with a greater height-to-span ratio than is contemplated for the use of the present beam type, that is, for the substitution of a fabricated truss-like beam for solid wood beams.

In accomplishing the fabricated beam construction herein, it is contemplated to utilize additional wood strips interposed between the wood chords for shear load absorption. The use of wood pieces between chords of a truss, in addition to the use of webs or struts, is known, for example, as disclosed in U.S. Pat. No. 3,748,809 issued to Jackson on July 31, 1973 and in Swiss Pat. No. 306,573, of Apr. 30, 1955 to Kampf. However, shear force absorption and resistance to bending are too limited by the constructions disclosed in those patents.

It is also known to use metal fasteners, nails, wire or the like to secure parts together as illustrated, for example, in the aforementioned patent to Jackson, Australian Pat. No. 247,162 of 1961 to Dixon, and French Pat. No. 667,419 of 1929, to Schaub.

None of the aforementioned patents are directed to the problem of the increased cost of lumber, nor the solution of using less expensive, lower grade, smaller cross-section lumber, with the use of fasteners and/or metal struts, to make a beam which will support the loading requirements of beams formerly made of higher grade, larger cross-section lumber.

For example, U.S. Pat. No. 3,748,809, issued to Jackson on July 31, 1973, illustrates a joist structure where metal fasteners are used to secure metal tension members to the chords of the joist. There is no teaching or suggestion of the use of face entry metal fasteners, inserted at an angle, to secure wooden members together to absorb shear loads, resist bending, resist relative slippage of the wooden members, or to self-energize the fastener under loading conditions to increase the friction between the wooden members, or for angling the fasteners upwardly toward the nearest beam end, all of which permit lower grade, smaller cross-sectional lumber to be used in a beam.

Australian Pat. No. 247,162, to Dixon, published Jan. 26, 1961, illustrates a joist where the apex joint, i.e., the joint where the loading and compressive forces neutralize each other, may be lightly held together by a nail inserted at an angle or alternatively by horizontal, face entry corrugated fasteners. There is no teaching or suggestion of the use of face entry metal fasteners, inserted at an angle, to secure wooden members together to absorb shear loads, resist bending, resist relative slippage of the wooden members, or to self-energize the fastener under loading conditions to increase the friction between the wooden members, or for angling the fasteners upwardly toward the nearest beam end, all of which permit lower grade, smaller cross-sectional lumber to be used in a beam.

The French Pat. No. 667,419 issued in 1929 to Schaub illustrates a composite concrete and wooden member having a tongue and groove arrangement therebetween, where metal fasteners such as nails or screws are embedded in both the concrete and wood. Again, there is no teaching or suggestion of the use of face entry metal fasteners, inserted at an angle, to secure wooden members together to absorb shear loads, resist bending, resist relative slippage of the wooden members, or to self-energize the fastener under loading conditions to increase the friction between the wooden members, or for angling the fasteners upwardly toward the nearest beam end, all of which permit lower grade, smaller cross-sectional lumber to be used in a beam.

SUMMARY OF INVENTION

The invention herein contemplates forming a truss-like beam out of a pair of parallel, elongated wood chords, between which are located relatively long end and central shear blocks or strips which fill the space between the two chords at the ends and at the center of the beam. In addition, metal web units or struts may interconnect the chords in the longitudinal spaces between the end and center blocks. The blocks or strips are connected to the chords in a manner which causes them to absorb considerable shear loads resulting from the beam loading. This substantially increases the strength of the beam for a given size, permitting the beam to be lower in height for a given span, and to be made of a lower grade lumber. The blocks may be made of scrap lumber, and still provide the necessary design strength.

Moreover, the invention herein contemplates interconnecting the shear blocks or strips to the chords by means of face entry staple-like or plate-like connectors which are angled in such a manner as to tend to tighten together the adjacent chord and strip surfaces under beam loading. That is, the fasteners are angled in such a manner that they are placed under tension due to beam loading. Consequently, the fasteners tighten or clamp the adjacent strip and chord portions together in proportion to the beam load. That is, the greater the beam load, the tighter the fasteners tend to compress the adjacent wood parts together to thereby increasingly absorb shear loads and resist loosening, separation or relative movement of the parts.

Thus, it is an object of this invention to provide a less expensive beam construction than that previously available with the ability to provide larger spans with lower truss heights than is usual, and to utilize lower grade and less expensive lumber while still providing the same or increased load carrying ability. Another object of this invention is to provide a method for interconnecting the wood parts of the truss-like beam which in essence is "self-energizing", i.e., increasing in its holding strength under increasing beam load so as to increase absorption of longitudinal shear forces between the shear blocks and the chords. Still a further object of the invention is to increase clamping together of the wood parts to substantially eliminate noise or squeaking which otherwise commonly occurs due to relative part movements under load.

These and other objects and advantages of this invention will become apparent upon reading the following description, of which the attached drawings form a part.

DESCRIPTION OF DRAWINGS

FIG. 1 is an elevational view of the truss-like beam herein.

FIG. 2 is an enlarged, fragmentary view of a portion of the beam.

FIG. 3 is an enlarged, elevational, end view of the beam.

FIG. 4 is an enlarged, elevational view of one of the metal struts and its integral connector plates.

FIG. 5 is an end view taken in the direction of arrows 5—5 of FIG. 4.

FIG. 6 is an elevational view of the strut of FIG. 4, but showing the opposite or inner face of the strut.

FIG. 7 is an enlarged, perspective view showing the struck-out teeth arrangement on the connector plate portions.

FIGS. 8, 9, 10 and 11 are cross-sectional views taken in the direction of arrows 8—8, 9—9, 10—10, and 11—11 respectively of FIG. 6.

FIG. 12 is a schematic view of the beam.

FIG. 13 is a schematic view of a portion of the beam showing deflection under load.

FIG. 14 is a schematic view, similar to FIG. 13, showing deflection under load with the fasteners positioned.

FIG. 15 is an enlarged, schematic view showing force vector diagrams on the ends of the beam and the angularity of the fasteners relative to the chords.

FIG. 16 illustrates, in perspective, a mechanical staple or plate-like corrugated fastener.

FIG. 17 illustrates a force diagram showing the force vector diagrams at the effective load center of the beam.

DETAILED DESCRIPTION

As illustrated in FIGS. 1 and 2, the truss-like joist or beam 10 is formed of an upper chord 11, spaced apart from a lower chord 12, with the two chords interconnected by means of W-shaped web units 14. The web units are formed of pairs of oppositely angled struts 15 and 16. The struts are interconnected by means of common or integral connector plate portions 17 at their upper ends and connector plate portions 18 at their lower ends. In addition, the free ends of the struts are provided with separate end connector plates 19.

The web units are made of stiff, but relatively thin, sheet metal which may be stamped out in the form indicated. The gauge or thickness of the sheet metal may vary depending upon the expected design load standard set for the truss but typically is either 18 gauge or 20 gauge.

The upper and lower chords are formed out of wood strips, such as common 2×4's of sufficient length, or spliced to sufficient length as is commonly known. The chords are preferably rectangular in cross-section and the actual cross-sectional sizes may vary in order to make up the desired beam height. By way of example, if the chords are 2×4's, set on narrow end, the space between them is the same as the height of the chords. Thus, the web unit is sized to span that space between the chords so that the overall unit may be theoretically twelve inches in height, but actually more near ten inches in height because of the difference in actual lumber size as against indicated size. By varying the cross-sectional size of the chords, or positioning their greater size horizontally, the beam height may be varied.

Each of the connector plates are provided with a number of punch-outs or strike-outs 20 to form either separate teeth or pairs of teeth 21, as illustrated in FIG. 7. The particular configuration of the teeth and the size and shapes of the punch-outs and whether the teeth are individually formed or formed in pairs, are factors known in the art. The particular size and shape may be selected from among those conventionally available. For example, one form of the teeth which can be used is shown in my earlier U.S. Pat. No. 4,002,116.

As shown in FIGS. 4–6 and 8–11, each of the struts is made of a channel having a base 22 and edge flange-like legs 23. The strut forming channels are preferably wider at their lower ends than at their upper ends and gradually taper from wide to narrow. These preferred features, as well as others described herein which relate particularly to the web units and struts, are described in detail in my U.S. application Ser. No. 113,171, which was filed Jan. 18, 1980, now U.S. Pat. No. 4,308,703.

The base of each strut is rounded at its lower end and gradually decreases in roundness or curvature toward its upper end which is flattened. The degree of curvature may vary depending upon calculated design loads, but may be roughly on the order of a segment of a circle of relatively short radius at the lower end, with the radius gradually increasing along the length, going upward of the base, until the base becomes substantially flat at the upper end.

Further, it is preferable that the legs 23 of the channels gradually increase in height or depth, measured from the base 22 of the channels, going from the bottom toward the upper end of each strut. That is, in essence, the channels forming the struts become deeper from the bottom toward the upper end, narrower from the bottom toward the upper end, and with the base less curved from the bottom toward the upper end.

One end of each of the strut channel legs is extended at 25 for overlapping and embedding into a portion of the chords adjacent the tooth 26 which is closest to the free end of the respective connector plate (see FIG. 6). This substantially increases the holding power of that tooth 26 which otherwise is under considerably greater strain or load than the other teeth and tends to release from the wood more easily than the other teeth.

The common connector portions are also provided with inwardly extending flat extension strips 28 which are integral with the plates but extend into the space between the chords. Similar strips 29 are formed integral with end connector plates 19. These extensions serve to increase the load carrying capacity and resist twist-outs of the teeth from the wood due to sidewise torque forces.

The composite beams also include opposite end filler strips or shear blocks 35 and 36 and a center filler or shear block 37. These filler strips or shear blocks are sized to fill the vertical gap or space between the upper and lower chords and preferably are substantially the same width as the chords or at least one of the chords. These filler strips or shear blocks may be made of scrap lumber resulting from the production of the upper and lower chords. Their lengths may vary as will be described below. The filler strips or shear blocks are in tight face-to-face, frictional contact with the upper and lower chords 11 and 12. That is, adjacent faces of the blocks and chords are in surface to surface contact.

The filler strips or shear blocks are mechanically fastened to their respective adjacent chord portions by means of face-entry mechanical fasteners. One form of mechanical fastener is illustrated in FIG. 16. This fastener is a commercially available so-called "staple" or plate-like mechanical fastener 40. It is made of a metal strip which is corrugated and the corrugations or flutes 41 are angled toward each other from top to bottom so as to draw together the adjacent wood parts as the staple is pounded in or pushed into the faces of the adjacent surfaces of the wood members to be fastened together.

An alternate form of staple is disclosed in my copending application Ser. No. 332,165, filed Dec. 18, 1981, entitled "Improved Corrugated Staple".

For assembly, the chords are laid side-by-side, spaced apart, with the web units positioned upon their upper surfaces and lower surfaces on opposite sides of the chords. The application of pressure pushes the connector portions inwardly toward the wood so as to embed the respective teeth into the overlapped wood portions and to simultaneously embed the leg extension portions 25. In that manner, the truss-like beams are assembled. When shear blocks or filler strips are provided for the beam, the blocks or strips are placed and stapled in position between the chords before the web units are positioned and secured in place.

The arrangement of the fasteners relative to the chords and strips is significant as the invention includes angling the fasteners at approximately pre-determined angles which are transverse and cross-grain to the respective strips and chords with the angle of the fasteners generally extending upwardly and at an acute angle in the direction of the nearest beam end.

The angular arrangement of the fasteners is illustrated in FIGS. 12–15 and 17. Thus, referring to FIG. 12, the truss-like beam 10 is schematically shown with the web connectors 14 in dotted lines and the fasteners 40 angled. The beam shown in FIG. 12 is in repose, i.e., not under applied load.

FIG. 13 schematically shows the deflection of the beam under applied load, assuming the absence of the fasteners 40. For illustration purposes, the deflection is greatly exaggerated. Thus, the applied load upon the bent beam is indicated by downwardly pointed arrows 45 and the beam is supported by end supports illustrated by the upward force arrows 46.

When the beam deflects between its opposite end supports, there is a relative slippage or endwise movement between the upper chord 11 and the shear blocks 35, 36 and 37 and also between the shear blocks and the lower chord 12. In FIG. 13, the relative slippage is indicated by the arrows 47 at the end shear block 35. At the center shear block 37, the relative slippage is indicated by arrows 48 directed towards the left and arrows 49 directed towards the right of the effective load centerline 50. Summarizing, it can be seen that there is a normal tendency for the three separate wood strips, i.e., the chords 11 and 12 and each of the shear blocks 35, 36, and 37 to slip relative to each other as shown in the exaggerated diagram of FIG. 13.

The resistance to bending of a beam is a cube function of its depth or height. Thus, a single wood strip, such as one of the chords, resists bending according to the cube of its height. The resistance to bending of the lamination of the three relatively movable strips, i.e., the upper chord, shear block and lower chord, is the sum of each of the three resistances to bending. For example, if each of the chords and strips were one inch in height, the resistance to bending would be the sum of the cube of each of the one inches. This amounts to $1^3+1^3+1^3$, which added together make three.

However, if the three laminate forming strips were fastened together so as to prevent slippage, i.e., to form a solid unit, the resistance to bending would be the cube of the overall height. In the example given above the overall height is three. The resistance to bending is the cube of three (i.e., the height of the now solid lamination) and the result is nine. Consequently, it can be seen that by locking the three wood strips together to avoid the relative slippage, there is a substantial increase in resistance to bending. For any building or other application, the heights of the wood strips and the lengths of the end and center shear blocks depend upon the expected beam loads and the beam length, and anticipated deflection. This may be calculated or empirically determined by testing of different sizes and types of lumber.

In addition, the natural tendency of the chords and wood strips to move relatively to each other under load, such as of a person walking on a floor, would normally tend to produce a squeaking sound which is common in floor constructions where on piece of wood rests upon and is supported by another. Thus, preventing relative movement of the parts reduces squeaking and gives a firmer feel to a floor.

By appropriately angling the fasteners 40, the three contiguous wood strips may be interlocked and relative motion between them prevented. This is illustrated in FIG. 14 where the exaggerated bent beam is shown with the chords 11 and 12 and the end strip 35 and center strip 37 prevented from slipping relative to each other by the angularity of the fasteners. The fasteners are set approximately at the angle of the hypotenuse of certain force vector diagrams made up of the horizontally directed shear forces and the upwardly directed force opposing the force caused by the beam loading. Thus, referring to FIG. 15, the applied beam load is designated as arrow 45 and the upward supporting column force is designated by the arrow 46. The resultant force in the beam caused by the downward load 45 may be broken up into the horizontally directed shear force 54 and the upwardly directed transverse force 55. Added vectorially, these two forces give a staple load 56.

Utilizing the force vector of the shear force 54 which is directed toward the nearest beam end, and the upward resultant transverse force vector 55, a force vector triangle can be constructed with its hypotenuse 56 sloping upwardly and toward the nearest beam end. The fasteners are then arranged along the angle of the force vector hypotenuse 56, as closely as possible. Of course, the force vectors and angles of the hypotenuse will change along the length of the beam (depending on the loading). In practical construction, it is not feasible to get the fasteners exactly upon the hypotenuse angle without excessive time and care. Thus, it is contemplated that the fasteners will be arranged, in most cases, approximately or roughly along the angles of such hypotenuses 56 as illustrated by the corrugated lines 40*a* in FIG. 15.

Similarly, as shown in FIG. 17, the fasteners in the center shear block 37 are angled upwardly toward their nearest beam end. However, as is known, the direction of the shear load changes at the effective load center of the beam which may be at the exact center, or may be some distance off the exact center, depending upon the beam loading and support. However, as schematically shown in FIG. 17, utilizing the approximate effective load center or zero point of the changing direction of the loads designated by the center-line 50, force vectors may be constructed on opposite sides of that centerline. Such force vector diagrams each comprise a horizontally directed shear force 58 and an upwardly directed transverse or normal force 59 and a hypotenuse vector 61. The fasteners 40 are arranged approximately along the angle of the hypotenuse 61 of each of the force vectors so that on one side of the centerline 50 the fasteners angle in one direction and at the opposite side they angle in the opposite direction. That is illustrated in FIGS. 1 and 12.

I have determined, both by mathematical calculations and by shear testing, the criticality of the range of the angle of insertion of the fasteners. Specifically, I tested and calculated using number 2-D southern pine wood. I first performed a shear test where forty-eight metal fasteners, spaced apart on two-inch centers, were face-entry inserted at an angle of 35° from the vertical. Vertical refers to the orientation when a truss is in the position shown in FIG. 12 of my application. Based upon the test, to determine the shear capacity of the fasteners, there was no fracture until 20,000 pounds of load was applied. Since there were forty-eight fasteners this indicated that the shear capacity was 417 pounds per fastener.

Having determined the shear strength "S" of the fasteners, hereafter referred to as staples, the maximum load "$L_V$" which can be supported without exceeding the shear strength "S" is determined by the formula $L_V = S/\tan\phi$. "$\phi$" is defined as the angle at which the staple is inserted into the wood members, the angle being measured from the vertical. Hence, if "$\phi$" is small, tangent $\phi$ is small and the maximum load would be larger. However, the angle cannot be too small or there will be no resistance to bending, i.e., the staple will bend over in the wood.

It is important to place the staples in tension because the result of placing the fasteners in tension is to compress the wood members against each other. Tension "T" may be expressed by the formula $T = L_V/\cos\phi$. Hence, for a given load, if $\phi$ is large, $\cos\phi$ will be small, and the tension on the staple will be larger. The angle cannot be too large because as the angle approaches 90° from the vertical, the staple would be too flat, i.e., almost horizontal, and will pull out of the wood rather than holding the wood members together.

Thus, there are "opposite" criteria for the angle "$\phi$". By "opposite", I mean one reason for the angle to be small (maximum load without exceeding shear strength) and one reason for the angle to be large (increasing tension on the staple). Hence, the angle at which the fasteners are inserted is an important factor.

We turn next to the "self-energizing" effect of the fasteners. Knowing that the compression of the wood members against each other in opposition to the normal or vertical component of the tension on the fastener creates friction, and knowing that the total horizontal load is a combination of the actual shear on the fastener plus the friction, I use the following formula:

$$F = S_A U \cot\phi.$$

Friction F equals shear $S_A \times U \times \cot\phi$; where U equals the coefficient of friction for wood. Actual shear is the actual horizontal staple load.

Thus, the total horizontal load is the actual shear on the staple $S_A$ plus friction F; $L_H = S_A + F$; But $F = S_A U \cot\phi$. Solving the equations to determine friction F yields:

$$F = L_H[1 + 1/U \cot\phi,] \text{ or}$$

$$F = L_H U \cot\phi/[1 + U \cot\phi].$$

U is the coefficient of friction for wood which, according to Marks Handbook can have a range of 0.3–0.6. In my calculations, I take the smaller value 0.3.

Thus, it is desired to decrease the angle $\phi$ to maximize the frictional force between the wood members, as a percent of the total horizontal load, since maximum friction reduces the actual shear on the staple. But decreasing the angle $\phi$ too much will result in the problem of the staple bending when the beam is loaded.

From the foregoing, I conclude that the fact of an angular relationship of the staple from the vertical is critical and that there should be a preferred range of "angles" for the staple to function as desired, since it is not economically feasible to always insert the staple on the hypotenuse of the force vector diagram.

I have made sample calculations as illustrated by the following table. In each instance I assume the vertical load $L_V$ to be 100 pounds. The first row in the table, $L_H$, refers to horizontal load $L_H = L_V \tan\phi$. The second row is tension $T = L_V/\cos\phi$, assuming no friction. Row 3 is the friction F from the formula above; row 4 is the actual shear on the staple $S_A = L_H - F$; and row 5 is the actual tension on the staple $T_A = S_A/\sin\phi$.

From the table, I have found that the range of 30° to 40° from the vertical is preferred for the angle of insertion of the mechanical fastener. At angles of 50°, and higher, the effect of the friction is too slight in proportion to the total horizontal load, i.e., the actual shear is too large a percent of the horizontal load. The friction does not sufficiently reduce the shear on the staple. It must also be remembered that at higher angles there is less resistance to the fastener pulling out of the wood and the actual shear is quickly approaching the maximum shear strength of the staples. Also at angles of 50° and higher the actual tension $T_A$, exceeds the vertical load and at angles of 60° and higher the atual shear $S_A$, exceeds the vertical load which means that no real benefit is obtained. The object is to minimize the number of fasteners and the shear thereon, while providing sufficient tension to create friction. At angles of 20° and lower the fastener will tend to bend. Thus to maximize the benefit of the use of fasteners, and to minimize the number of fasteners, to reduce cost and so that the fasteners are not too close together, a range of between about 30° to 40° is preferred for the angle of the fasteners.

TABLE

SHEAR, LOAD & TENSION AT DIFFERENT ANGLES FIRST ASSUMING NO FRICTION AND THEREAFTER ASSUMING FRICTION ANGLES IN DEGREES - ALL OTHER VALUES IN POUNDS

Vertical load $L_V = 100$

| row | | 20° | 30° | 40° | 50° | 60° | 70° |
|---|---|---|---|---|---|---|---|
| 1 | $L_H$ | 36.4 | 57.7 | 83.9 | 119.2 | 173.2 | 274.8 |
| 2 | $T_{no\ friction}$ | 106.5 | 115.5 | 130.6 | 155.5 | 200.0 | 292.4 |
| 3 | F | 16.4 | 19.7 | 22.1 | 24.0 | 25.5 | 27.0 |
| 4 | $S_A$ | 20.0 | 38.0 | 61.8 | 95.2 | 147.7 | 247.8 |
| 5 | $T_A$ | 58.5 | 76.0 | 96.1 | 124.3 | 170.6 | 263.9 |

Thus, the angularity of the fasteners places the fasteners in tension under applied beam load. The fasteners tend to act like rubberbands, i.e., tending to stretch under beam load, but due to their stiffness, resist the stretching and thereby compress together the wood parts in which they are embedded. The greater the applied load, the greater the resistance of the fasteners to stretching and the greater the force applied by the fasteners to compact or squeeze together the adjacent wood pieces. In essence, there is a "self-energizing" effect which increases the resistance to relative slippage between the wood strips and increases the tight frictional engagement between the strips in response to increased load applied to the beam.

Typical lumber can handle roughly 175% the bending stress compared to the stress of tension. Thus, with the absorption of much of the shear forces by the shear blocks, which resist slipping relative to each other and thereby absorb such loads, and by increasing the bending resistance because of the unitizing effect of binding the chords and center strips together, the beams can handle considerably greater loads. By way of example, utilizing a dense Southern Pine chord which will handle about 1,350 pounds in tension per square inch, the composite joist design load can be increased to roughly about 1,750 pounds per square inch because of the absorption of the shear component in the chord and shear block.

In accordance with the invention, joists or beams can be constructed without any web units 14, utilizing only the shear blocks or filler strips and the angled fastener arrangement, and provide a beam made only of wood which has much greater strength and bending resistance than any comparable beam.

Moreover, as a result of angling the fasteners, it is possible to utilize considerably fewer fasteners in constructing beams. On a manufacturing or large scale beam production basis, the reduction in the number of fasteners means a considerable reduction in the expense of fastening, that is, labor charges, machine charges, cost of the fasteners, etc. Also, the beam can be designed for a predetermined load comparable to a conventional beam, but because of the increased strength, thinner metal and lower grade lumber may be used to thereby reduce the cost. Since lower grade lumber is more readily available and since it is not necessary to use large cross-sectional size beams, the overall cost is considerably reduced and the availability of lumber is considerably broadened.

Having fully described an operative embodiment of this invention, I now claim:

1. In a composite beam formed of a pair of vertically spaced apart, elongated wood chords which are interconnected along their lengths, and with an elongated wood filler strip spanning and filling the space between and fastened to the chords, the elongated wood chords and elongated wood filler strip each having elongated faces and elongated edges and with the elongated edges of the strip being parallel to and in contact with elongated edges of the adjacent chords, and with the beam being formed to support a predetermined load having longitudinal and normal force components relative to the chords, the improvement comprising:

the wood strip being fastened to both of the chords by means of a number of elongated generally plate-like mechanical fasteners, each of which is embedded substantially equally into the faces of the wood strip and a chord for joining together adjacent portions of both the wood strip and a chord;

each said fastener being arranged at an acute angle from the vertical so that each fastener slopes upwardly and toward its nearest beam end for placing the fastener under tension under the application of downwardly directed loads upon the beam, whereby the fastener resists the tendency of the chords and strip to separate, but rather tends to compress together corresponding chord and wood strip elongated edge portions under such beam load and consequently maintains substantial frictional contact between adjacent contacting chord and strip elongated edges for absorption of part of the longitudinally directed shear force components of the applied beam load, and for increasing the load bearing capacity of the beam; and wherein said wood strip is located over the portion of the beam where the direction of the longitudinal force component changes, so that one part of the length of the wood strip overlaps chord portions having longitudinal shear force components of one direction, and the opposite part of the length of the wood strip overlaps chord portions having their longitudinal shear force components oppositely directed, and with the fasteners on opposite sides of the location where the force direction changes being correspondingly angled upwardly toward their nearest beam end so that the fasteners are all ordinarily under tension when the beam is loaded, regardless of the two different longitudinal shear force component directions.

2. The beam as defined in claim 1 wherein said filler strip extends the full length of said beam.

3. A composite beam comprising:

interconnected, horizontally extended upper and lower, vertically spaced apart, approximately rectangular cross-section wood chords of substantially uniform width;

at least one horizontally elongated wood strip of approximately rectangular cross-section, fitted between and spanning the space between the chords for a portion of the beam length, the chords and wood strip each having faces and opposed edges, the wood strip upper and lower edges in contact with the respective chord lower and upper edges respectively;

a number of metal, elongated, plate-like fasteners, each embedded in the adjacent faces of and mechanically joining together adjacent portions of the wood strip and the respective chord, so that said wood strip is joined to both of said chords;

each of said fasteners, in their elongated direction, being acutely angled from the vertical at an upward slope toward its nearest beam end, and with the angle of each fastener being roughly aligned with the angular direction of alignment of the hypotenuse of the force vector triangle formed of the endwise directed horizontal and the vertical upwardly directed force vectors resulting from a predetermined load on the beam at the approximate location of the fastener, and wherein each fastener is angled from the vertical between about 30° and 40° at an upward slope toward the nearest beam end; and whereby the fasteners are each normally placed in tension under application of beam loads and tend to compress together, in tight frictional contact, the contacting wood strip and chord edges for absorption by both the strip and fasteners of part of the shear load component due to the applied beam loads.

4. A composite beam as defined in claim 3, wherein said wood strip is located at one end of the beam so that such end of the beam is formed of a lamination of the adjacent portions of the upper chord, wood strip and lower chord and said beam is adjustable in length by cutting off sections of the free end of the lamination to reduce the beam to desired length.

5. A composite beam as defined in claim 3, wherein said wood strip is located centrally of the chords to span the area of the chords where the applied beam load induced longitudinal shear force reverses directions, and said fasteners are oppositely angled on the opposite side of said area, so that the fasteners are all in tension under beam load.

6. A composite beam as defined in claim 3, wherein three wood strips are provided, one located at each of the opposite ends of the beam and the third located in the center of the beam, so that the beam is formed of the two chords and three longitudinally spaced wood strips, with each of the fasteners for each of the wood strips being approximately angled to correspond to the angular alignment of the hypotenuse of said force vector triangle at the location of said fastener, so that each fastener is under tension in response to the applied load.

7. A beam comprising:

a normally horizontally extended, vertically spaced apart, parallel upper and lower, approximately rectangular cross-section wood chords of substantially uniform width, the chords each having edges and faces;

a pair of normally horizontally extended wood filler strips, each of approximately rectangular cross-section and fitted within and filling the space between the chords at opposite ends of the beam and each extending from the respective free end of the beam for a predetermined, relatively short distance inwardly, toward the center of the beam, each filler strip having faces and opposed edges with the upper and lower edges of each strip being in substantially full tight, frictional contact with its adjacent chord edge;

a center wood filler block arranged between and filling the space between the chords at the central portion of the beam and overlapping the area where the longitudinal, endwise directed, shear forces, resulting from applied beam loads, change direction, so that there are horizontal elongated gaps between the chords and the adjacent ends of the center wood filler block and the end strips, said filler block having a face and opposed edges;

the wood strips and wood filler block being fastened to their adjacent chord portions by elongated plate-like mechanical fasteners, each fastener inserted at an acute angle from the vertical in the face of one of the chords and the faces of the adjacent filler, and wherein said mechanical fasteners are angled to approximately correspond to the angular alignment of the hypotenuse of a force vector triangle at the location of each of said fasteners, so that each fastener is under tension in response to the applied load;

whereby a part of the longitudinal shear force components, which are due to the vertically downwardly applied loads upon the beam, are absorbed by the strips and block, and fasteners, and the fasteners are placed in tension when the loads are applied to the beam, the tension on the fasteners for maintaining frictional contact between each chord and the strips and block thus reducing the shear force on the fastener.

8. A method of forming a composite beam by assembling together a pair of spaced apart, elongated wood chords and interconnecting the chords with members which span the space between them, with said interconnecting members including at least one elongated wood filler strip which spans and fills a portion of the space between the two chords, the chords and interconnecting members each having faces and edges and with the filler strip edges in contact with the opposed edges of the portion of the chords which are overlapped by the filler strip, the improvement comprising the steps of:

fastening the chords and strip together by embedding a number of plate-like mechanical fasteners edgewise into the adjacent face portions of each of the chords and the wood filler strip at approximately a pre-determined angle relative to the longitudinal direction of the chords;

said pre-determined angle for each fastener being roughly the angle of the hypotenuse of a force equilibrium vector diagram made up of a longitudinal force vector and a normal force vector resolved from a predetermined load applied transversely upon the beam, with the orientation of said hypotenuse angle being such that each of the fasteners is placed in tension upon such applied load and thereby tends to compress the chords and strip together in proportion to the applied load;

positioning a wood filler strip at each opposite end portion of the beam, and also at the central portion of the beam to overlap the area where the longitudinal shear force, due to such applied load, changes directions;

and fastening each of said strips to the chords at such predetermined angles, wherein the fasteners are oppositely angled at the opposite end strips, and the fasteners in the strip located at the central portion of the beam being oppositely angled relative to said area, and wherein said predetermined angle is between about 30° and 40° measured from the vertical.

* * * * *